US005430449A

United States Patent [19]

Frazho et al.

[11] Patent Number: 5,430,449

[45] Date of Patent: Jul. 4, 1995

[54] MISSILE OPERABLE BY EITHER AIR OR GROUND LAUNCHING

[76] Inventors: David B. Frazho, 1648 Berwick, Westlake Village, Calif. 91361; Marc A. Wynn, 417 Galsworthy St., Thousand Oaks, Calif. 91360; David F. Weins, 18804 Lenay St., Reseda, Calif. 91335

[21] Appl. No.: 147,604

[22] Filed: Nov. 4, 1993

[51] Int. Cl.[6] ..... F41G 7/00

[52] U.S. Cl. ..... 342/62; 244/3.15

[58] Field of Search ..... 244/3.15; 342/62

[56] References Cited

U.S. PATENT DOCUMENTS

| | | | |
|---|---|---|---|
| H455 | 4/1988 | Helton | 244/3.15 |
| 4,037,202 | 7/1977 | Terzian | 364/200 |
| 4,093,153 | 6/1978 | Bardash et al. | 244/3.15 |
| 4,530,270 | 7/1985 | Denaci | 244/3.15 X |
| 5,048,771 | 9/1991 | Siering | 244/3.15 |
| 5,096,139 | 3/1992 | Feld et al. | 244/3.15 X |
| 5,176,337 | 1/1993 | Lee | 244/3.15 |

*Primary Examiner*—Mark Hellner

*Attorney, Agent, or Firm*—R. M. Heald; C. D. Brown; W. K. Denson-Low

[57] ABSTRACT

A missile (20) includes a missile body (22) having a propulsion motor (26), a gimballed target seeker (32), and control fins (30) for altering the flight path of the missile (20). The missile (20) has a missile flight control unit (44) which provides an indicator of the launch status of the missile (20) as to whether the missile (20) is launched from a fixed location or from a moving vehicle. The initiation of the guidance of the missile (20) toward a target (60) by the control fins (30) and the guidance law of the missile (20) are established responsive to the launch status indicator.

12 Claims, 2 Drawing Sheets

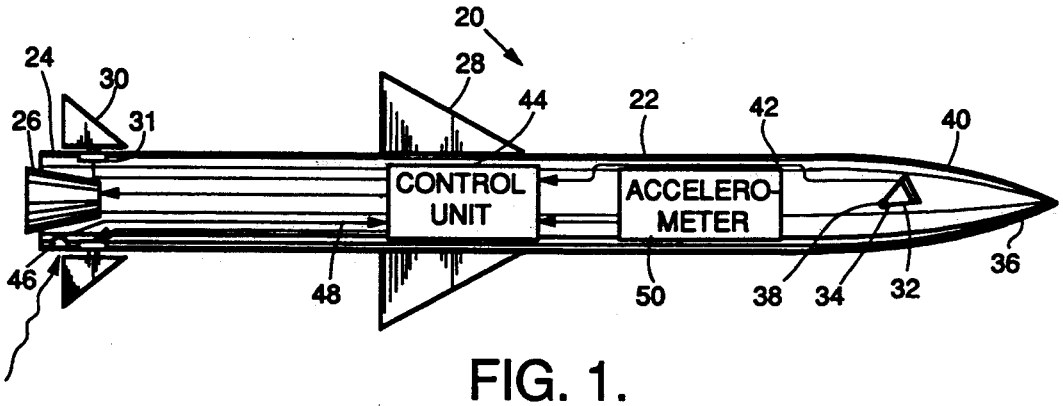
FIG. 1.
FIG. 2.
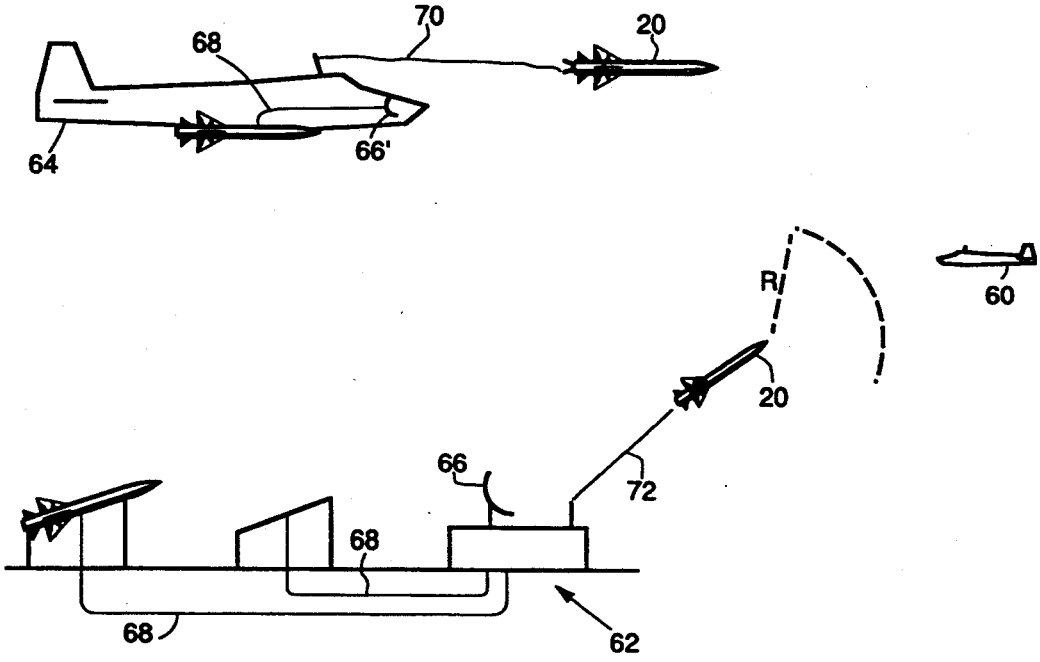

MISSILE OPERABLE BY EITHER AIR OR GROUND LAUNCHING

BACKGROUND OF THE INVENTION

This invention relates to guided missiles, and, more particularly, to a type of guided missile that may be launched from an aircraft or a stationary location.

Missiles operable against a flying target have traditionally been developed as either air-launched (i.e., air-to-air) or ground-launched (i.e., ground-to-air) missiles. An air-to-air missile is launched from a fast-moving aircraft, while a ground-to-air missile is launched from a relatively stationary launcher such as a fixed ground-based launcher or a naval vessel.

One important type of air-to-air missile, the Advanced Medium Range Air to Air Missile, or AMRAAM, is initially directed toward a target after launching by an aircraft and guided during mid-course flyout by a targeting aid such as a radar that is locked onto the target. The targeting aid is not onboard the missile, but instead is on the launch aircraft or at some other location. The targeting aid can give the approximate position of the target at great distances. The approximate position of the target as determined by the targeting aid is communicated to the missile and its guidance system by radio.

A gimballed seeker, such as an infrared sensor, within the missile can determine the position of the target very accurately, but only from a relatively short distance. During the portion of the missile flight when the target is beyond the range of the seeker, the seeker is pointed toward the target by the movement of the gimbal. The seeker does not, however, actively control the flight of the missile until the missile nears the target. During the final stages of the flight of the missile when the target is within the range of the seeker, the seeker locks onto the target, takes over control of the guidance of the missile, and provides the information to guide the missile to the target.

If an attempt is made to use such an air-to-air missile of the AMRAAM type as a ground-to-air missile by launching it from a fixed ground location instead of a fast-moving aircraft, in many instances the mission is unsuccessful and the missile does not intercept the target. This is unfortunate, as the AMRAAM-type missile has proved to be very valuable in the air-to-air role, and its many features could desirably be used in the ground-to-air mission.

There is therefore a need for an approach by which such air-to-air missiles could be used as well in a ground-to-air mission. Most preferably, the same missile could be adapted for use in both roles. The present invention fulfills this need, and further provides related advantages.

SUMMARY OF THE INVENTION

The present invention provides a missile that can be used in both the air-to-air and ground-to-air missions. The missile is controlled by the combination of a targeting aid for long-range guidance and an onboard gimballed seeker for terminal guidance. The missile can be launched in the conventional manner from a fast-moving aircraft, but can also, with internal modifications as indicated herein, be launched from a stationary location against a flying target. Thus, a high degree of commonality is attained so that economies of manufacturing can be achieved, so that it is not necessary to store and maintain different types of missiles, and so that-operations personnel can be trained for only a single type of missile.

In accordance with the invention, a missile operable by either air launching or ground launching comprises a missile body having means for altering the flight path of the missile, and a missile flight controller within the missile body. The missile flight controller includes means for receiving a target location vector from an external targeting aid, means for setting a launch status indicator of the missile as to whether the missile is launched from a fixed location or from a moving vehicle, and means for controlling the guidance of the missile after launching. The means for controlling is responsive to the launch status indicator of the means for setting.

In one embodiment of the missile, the missile further includes means for determining the velocity of the missile, and the means for controlling includes means for initiating the targeting guidance operation of the means for altering the flight path of the missile after the missile has reached a preselected minimum velocity, responsive to the launch status indicator of the means for setting that the missile is launched from a substantially fixed (nonmoving or slowly moving) location. In another aspect, the means for controlling includes means for establishing a guidance law of the missile responsive to the launch status indicator of the means for setting. The means for establishing a guidance law can include means for establishing a trajectory shaping of the missile responsive to the launch status indicator of the mean s for setting. Preferably, all of these features are used together in the controller.

The investigations leading to the present invention established that a primary cause of the failure of conventional air-launched missiles in a ground-launched role is excessively large guidance commands during the initial phase of ground-launched flight. These large guidance commands lead to excessive gimbal angle drive commands issued to the seeker. The result is possible damage to the seeker and also erratic flight of the missile during the early phase of the ground-launched missile.

One potential solution is to redesign the seeker and gimbal unit. Such a redesign would be costly and potentially costly to implement. A redesign would also have to be requalified for the air-to-air mission.

Instead, it has been discovered that the problems can be avoided by delaying the initiation of the active missile guidance to the target until the ground-launched missile has reached a preselected velocity. The principal relevant difference in the operation of the air-launched missile and the ground-launched missile is that the ground launched missile starts from zero velocity rather than a relatively high velocity, typically about Mach 0.9, characteristic of the air-launched missile. At such an air-launched speed, the missile makes only relatively small directional corrections initially, so that the seeker is not forced to make large, rapid movements to continue to point toward the target.

When the missile is launched from zero velocity with the targeting guidance active, there may be large, rapid movements of the control surfaces because of two reasons. First, at low missile velocity the control surfaces must make large movements to have any significant effect on the missile orientation. Second, during launch from zero velocity the missile may undergo flight attitude changes not experienced in such a degree in launch from higher velocity. There is typically a large pitch up of the attitude of the missile shortly after launch. If the missile targeting guidance is active during this period, the seeker will gimbal rapidly in an opposite direction to any missile direction change, and may exceed safe operating limits with the result that the gimbal is damaged.

When the initiation of targeting guidance of the ground-launched missile is delayed until the missile reaches a preselected velocity, preferably about Mach 0.9, the missile has reached a suitable speed for crisply responsive control movements, avoiding the first of the problems discussed in the preceding paragraph. The initial attitude changes are also completed, avoiding the second problem. At this point, the active targeting guidance and seeker pointing are initiated, with this aspect of the ground-launched missile responding in a manner generally comparable with that of the air-launched missile.

However, the subsequent operation of the ground-launched missile is not absolutely identical to that of the air-launched missile, and secondary changes to the two operational modes are preferred. The ground-launched missile never reaches the same velocity (measured at fixed times after launch or a fixed time to intercept) reached by the air-launched missile, simply because the air-launched missile starts with a high velocity. If the target is moving, the ground-launched missile must "lead" the target by a greater amount than the air-launched missile. The guidance and the trajectory of the missile must therefore be altered responsive to the ground-launched condition, always keeping in mind the necessity of avoiding excessively large or rapid gimbal movements of the seeker.

The present invention provides commonality between air-launched and ground-launched missiles of the type that carries an on-board seeker. The commonality is achieved with a relatively inexpensive modification to the missile system. The airframe of the missile is not modified. Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 1 is a schematic side sectional view of a missile;

FIG. 2 is a schematic depiction of the guidance approach for the missile; and

DETAILED DESCRIPTION OF THE INVENTION

Figure 3:
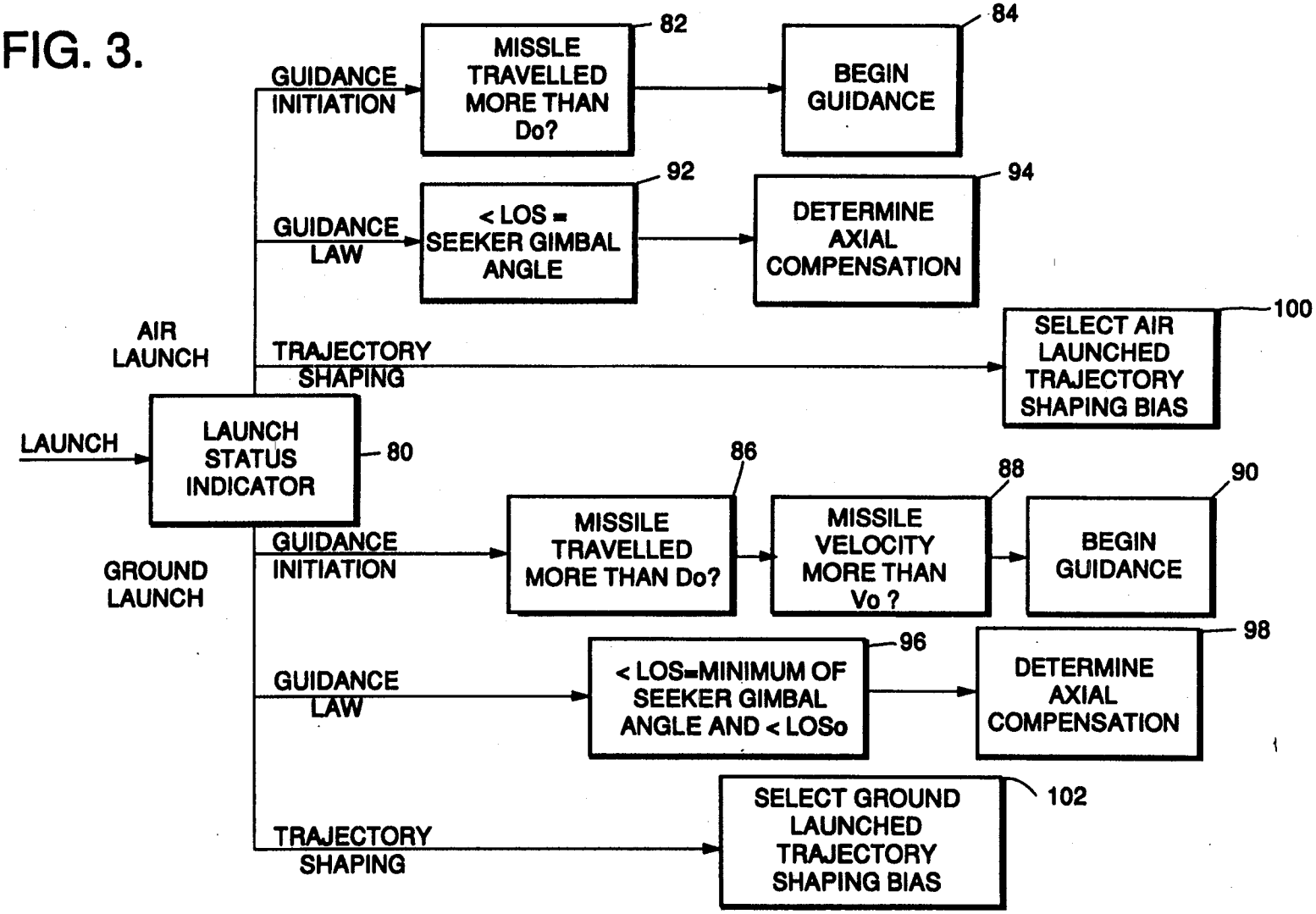
FIG. 3 is a diagrammatic process flow diagram for the control of the missile in the ground-launched and air-launched roles.

FIG. 1 depicts a missile 20 of the type that can be used in either an air-launched or a ground-launched role, according to the present invention. The missile 20 has a body 22. Within the body 22 near an aft end 24 is an propulsive engine, preferably a rocket motor 26. Lift is supplied by the body 22 and, for some missiles, two or more (four for the AMRAAM, as shown in FIG. 1) wings 28 attached to the body 22. The flight path of the missile 20 may be altered by the pivoting of one or more of four (two of which are out of the plane of view) control fins 30 mounted near the aft end 24 of the missile 20 and operated by rotational actuators 31.

A seeker 22 is mounted on a two-axis pivoting gimbal 34 at a nose end 36 of the missile 20. (One axis of rotation 38 is shown, and the other lies in the plane of the illustration.) The seeker 32 may be an infrared, visible light, or, in the case of AMRAAM, radar sensor, for example, and views the forward scene through a window or radome 40 that is transparent to the particular radiation in use. The seeker 32 provides a signal 42 to a control unit 44.

Externally generated target location information is transmitted to the missile via a radio signal to a data link antenna 46 mounted on the body 22 of the missile 20. This information is received and provided to the control unit 44 as a signal 48. The control unit 44 utilizes the externally generated target location signal 48 and the signal 42 from the seeker 32 during the guidance of the missile 20 to intercept its target. An accelerometer 50 measures the acceleration of the missile 20, and from that information the velocity can be obtained by integration in the control unit 44.

FIG. 2 depicts the general approach for providing the location of a target 60 to the missile. The missile 20 is provided at a ground launch site 62 or on a friendly aircraft 64. A targeting aid, here a radar 66 at the ground launch site 62 (for a ground-launched missile 20) or a radar 66' (for an air-launched missile 20) on the aircraft 64, acquires the target 50 and locks to it. Target location information is transmitted to the missile prior to launch by a hard wire 68. Target location Information is transmitted to the air-launched missile after launch by a radio signal 70 from the aircraft 64, or to the ground-launched missile after launch by a radio signal 72 from the ground site 62. (FIG. 2 depicts two missiles 20 being used to intercept the same target 60, for ease of illustration and explanation. Normally, only a single missile is used against a target, to avoid interference between the two missiles.)

The targeting information provided through the radar 66 or 66' targeting aid guides the missile 20 to the approximate location of the target 60. However, since the target 60 may be many miles from the radar, the targeting information provided by the radar 66 or 66' is necessarily only approximate. The target location information from the radar targeting aid is therefore used during the early and mid-course flyout of the missile to the target, and final guidance is accomplished using the seeker 32. The seeker 32 has a limited range, indicated schematically by a radius of effectiveness R. When the missile 20 is within the distance R of the target 60, the seeker 32 acquires contact with the target 60. The control unit 44 switches from use of the externally received signal 48 to the use of the seeker signal 42 as an indicator of the location of the target 60. This seeker-generated target location information is used in the final stages of guidance to the target.

As long as the target-seeking guidance from the radar targeting aid is operational during launch and mid-course flyout, the gimbal 34 is driven to point the seeker 32 in the approximate direction of the target 60. If the missile changes course or orientation, the gimbal moves to keep the seeker pointing at the target. This continuous pointing of the seeker toward the target, even beyond the expected radius of operation R, is necessary because the point of acquisition of the target by the seeker cannot be predicted exactly beforehand, due to the varying nature of the target, countermeasures, and the background of the target. Stated alternatively, the value of R may vary in an unpredictable manner, and the seeker must be maintained in a ready state to acquire the target.

FIG. 3 depicts the approach utilized to permit otherwise-identical missiles to be launched either from the ground or from the air. At the time of launch of the missile (either from the ground or an aircraft), a launch status indicator is checked, numeral 80. The launch status indicator indicates whether the launch is from the ground or from the air. In the preferred approach, the launch status indicator is based upon an measure of velocity. If the velocity prior to launch is less than a preselected value, a ground launch is indicated. If the velocity prior to launch is more than a preselected value, an air launch is indicated. Other methods for determining the launch status indicator may be used to account for other situations. In one alternative approach, the launch status indicator is determined by a switch set automatically when the missile is attached to the launcher or is a manually operated switch set by launch crew.

At least one, and preferably three, factors in the missile operation are responsive to the launch status indicator. The most important is the point of guidance initiation. For an air launch, after the missile has travelled more than some minimum preselected distance Do, numeral 82, which is typically about 80 feet, guidance is initiated, numeral 84. For a ground launch, two conditions must be satisfied. First, numeral 86, the missile must have travelled more than the distance Do. Second, numeral 88, the missile must have a velocity greater than a preselected minimum velocity Vo, which is typically selected as about Mach 0.9 for an AMRAAM-type missile. From zero velocity an AMRAAM-type missile requires about 1000 feet to reach a velocity of Mach 0.9. It is apparent that the second condition relating to reaching Vo will be controlling in most instances. After these conditions 86 and 88 are satisfied, guidance is initiated, numeral 90.

As used here, initiating guidance means that the targeting guidance operation of the means for altering the flight path, here the control fins 30, is begun under command of the control unit 44 only after the preconditions are satisfied. Prior to this point, the control unit 44 seeks to fly the missile 20 in a straight line after launch. Thus, there may be some guidance commands from the control unit 44 and movement of the control fins 30 to maintain the straight line of flight, but the path of the missile is not altered toward the target.

As discussed earlier, during the initial stages of flight the rocket motor 26 is fired, normally causing the missile to pitch upwardly. When the missile is launched from the air, the missile is moving forwardly fast enough that the control fins 30 can effectively control the orientation of the missile to maintain it relatively steady. When the missile is launched from the ground, the missile is initially moving much slower than the target so that the guidance tends to command the missile to lead the target by too much and to fly toward an unobtainable point. It is desired to delay the initiation of guidance control of the missile until the missile is moving at the same order of speed as the target, so that such an inefficient trajectory is avoided.

During the initial stages of ground-launched flight the rocket motor fires with the same force as during the initial stages of air-launched flight, and there is a tendency for the missile to pitch upwardly. When launched from the ground at zero initial velocity, the missile is moving slowly and the control fins cannot as effectively control the orientation of the missile. The missile therefore tends to experience rapid, wide swings in orientation during the initial stage of ground-launched flight. If the targeting guidance were operational during this period, the seeker gimbal 34 would move rapidly and most likely to the extremes of its travel, as it tried to remain fixed on the target location as provided by the radar targeting aid. The gimbal 34 and/or the seeker 32 might be damaged by the rapid movements and the sudden stops as the gimbal reached its mechanical limits. By delaying the initiation of guidance until the missile reaches the velocity at which the control fins 30 can effectively control the missile to relatively small, well regulated directional changes, this potential source of damage to the seeker system is avoided.

The second factor that is determined responsive to the launch status indicator is the guidance law to be utilized by the missile. The missile does not fly directly at the target during most of the flight, but instead must lead the target along the flight path of the target. Since the ground-launched missile starts from a zero velocity and the air-launched missile starts from a high velocity, at comparable points along the flight path the air-launched missile will be moving faster than the ground-launched missile. Accordingly, the ground-launched missile will reach the target more slowly than the air-launched missile, and therefore must lead the target more. To account for the change in velocity of the missile (typically a slowing of the missile) as it approaches the target, a value termed the axial compensation or A(comp) is added to the guidance command. A(comp) is typically calculated, for both launch modes, as one-half of the guidance gain times Ax, the axial acceleration of the missile, times the tangent of an angle <LOS.

For the air-launched missile, <LOS is selected as the seeker gimbal angle required for a line of sight to the target, numeral 92. The axial compensation is determined from this value of <LOS, numeral 94. For the ground-launched missile, <LOS is selected as the minimum of two values, the seeker gimbal angle required for a line of sight to the target and a maximum permissible gimbal angle, <LOSo, numeral 96. The axial compensation is determined using the same approach as for the air-launched case, except that the minimum of the two values is used for <LOS, numeral 98. The angle <LOSo is normally selected as the maximum permitted gimbal angle, so that the missile does not lead the target by so great an angle that the seeker cannot continue to point toward the target. This approach prevents the ground-launched missile from leading the target as much as it might otherwise, and causes the ground-launched missile in some cases to follow a more circuitous path to the target than does the air-launched missile. On the other hand, the present approach has the advantage that the missile seeker will not lose its pointing direction to the target due to the leading of the missile exceeding the maximum gimbal angle.

The third factor that is determined responsive to the launch status indicator 80 is the trajectory shaping of the missile. For an air-launched missile, an air-launched trajectory shaping bias is selected, numeral 100. For a ground-launched missile, a ground-launched trajectory shaping bias is selected, numeral 102. The trajectory shaping bias alters the flight path to most efficiently engage the target at the end of the flight. For either a ground-launched missile or an air-launched missile, the missile is typically lofted above the target altitude so that it can intercept in a downward path to maintain velocity and the ability to steer the missile as the target is intercepted. The amount of loft, however, is selectable and can be different for the two cases of the ground-launched and the air-launched missiles.

The present approach has been comparatively tested against the conventional approach on a missile simulator program for the operation of the AMRAAM missile, for both air-launched and ground-launched roles. In this simulation, when the missile is launched from the ground but uses the guidance approach that is conventional for an air-launched missile, the gimbal soon encounters hardware limits after launch, and failure results. When the present approach of the launch status indicator and different procedures as indicated herein for the air-launched role and the ground-launched role are used, successful intercepts in both roles were achieved, out to the maximum flyout range of the missile. Thus, relatively inexpensive command modifications, rather than much more expensive hardware modifications, permit the missile to be used in both roles.

Although a particular embodiment of the invention has been described in detail for purposes of illustration, various modifications may be made without departing from the spirit and scope of the invention. Accordingly, the invention is not to be limited except as by the appended claims.

What is claimed is:

1. A missile operable by either air launching or ground launching, comprising:
- a missile body having means for altering the flight path of the missile; and
- a missile flight controller within the missile body, the missile flight controller including
  - means for receiving a target location vector from an external targeting aid,
  - means for setting a launch status indicator of the missile as to whether the missile is launched from a fixed location or from a moving vehicle, and
  - means for controlling the guidance of the missile after launching, the means for controlling being responsive to the launch status indicator of the means for setting.

2. The missile of claim 1, wherein the means for setting includes
- means for determining the velocity of the missile, and
- means for establishing the launch status indicator responsive to the means for determining the velocity.

3. The missile of claim 2, wherein the means for controlling includes
- means for initiating a targeting guidance operation after the missile has reached a preselected minimum velocity responsive to the launch status indicator.

4. The missile of claim 1, wherein the means for controlling includes
- means for establishing a guidance law of the missile responsive to the launch status indicator of the means for setting.

5. The missile of claim 1, wherein the means for controlling includes
- means for establishing a trajectory shaping of the missile responsive to the launch status indicator of the means for setting.

6. A missile operable over a range of launch velocities, comprising:
- a missile body having
  - a propulsion motor,
  - a target seeker, and
  - means for altering the flight path of the missile; and
- a missile flight controller including
  - means for receiving a target location vector from an external targeting aid,
  - means for determining the velocity of the missile;
  - means for setting a launch status indicator of the missile as to whether the missile is launched from a launcher which is moving with less than a preselected velocity, and
  - means for controlling the guidance of the missile after launching, the means for controlling being responsive to the launch status indicator of the means for setting.

7. The missile of claim 6, wherein the means for controlling includes
- means for initiating a targeting guidance operation after the missile has reached a preselected minimum velocity responsive to the launch status indicator of the means for setting.

8. The missile of claim 6, wherein the means for controlling includes
- means for establishing a guidance law of the missile responsive to the launch status indicator of the means for setting.

9. The missile of claim 6, wherein the means for controlling includes
- means for establishing a trajectory shaping of the missile responsive to the launch status indicator of the means for setting.

10. A missile operable by either air launching or ground launching, comprising:
- a missile body having
  - a propulsion motor,
  - a gimballed target seeker, and
  - means for altering the flight path of the missile; and
- a missile flight controller including
  - means for determining a velocity of the missile;
  - means for receiving a target location vector from an external targeting aid,
  - means for setting a launch status of the missile as to whether the missile is launched from a fixed location or from a moving vehicle, and
  - means for controlling the guidance of the missile after launching, the means for controlling being responsive to the means for setting, wherein the means for controlling includes
    - means for initiating a targeting guidance operation after the missile has reached a preselected minimum velocity, responsive to the launch status indicator of the means for setting that the missile is launched from a fixed location and the means for determining a velocity, and
    - means for establishing a guidance law of the missile responsive to the launch status indicator of the means for setting.

11. The missile of claim 10, wherein the means for setting is responsive to the means for determining a velocity.

12. The missile of claim 10, wherein the means for establishing a guidance law includes
- means for establishing a trajectory shaping of the missile responsive to the launch status indicator of the means for setting.

* * * * *